US005400733A

United States Patent [19]

Richter

[11] Patent Number: 5,400,733

[45] Date of Patent: Mar. 28, 1995

[54] BOAT RAMP

[75] Inventor: William Richter, Winnipeg, Canada

[73] Assignee: Accurate Fabricating Ltd., Winnipeg, Canada

[21] Appl. No.: 75,293

[22] Filed: Jun. 11, 1993

[30] Foreign Application Priority Data

Jul. 21, 1992 [CA] Canada ..... 2074321

[51] Int. Cl.[6] ..... B63B 35/44

[52] U.S. Cl. ..... 114/258; 14/2.5; 14/69.5; 405/2

[58] Field of Search ..... 114/344, 366, 375, 258; 405/1, 2; 14/2.5, 2.6, 69.5

[56] References Cited

U.S. PATENT DOCUMENTS 2,564,951 8/1951 Blagden ..... 405/2
3,587,874 6/1971 Graf ..... 405/1
4,505,619 3/1985 Sargent .

*Primary Examiner*—Jesus D. Sotelo
*Attorney, Agent, or Firm*—Murray E. Thrift; Adrian D. Battison; Stanley G. Ade

[57] ABSTRACT

A launching ramp for boats, float planes and the like has several ramp segments that are in normal use of the ramp, generally aligned and sloping downwardly into a body of water. To enable the easy removal of the ramp from the body of water, the ramp segments are hinged and equipped with stops so that when a cable is connected to the outermost end of the ramp, pulling in on the cable will pivot the outermost end segment upwardly until the stops limit this pivotal movement with respect to the next segment, whereupon the second segment will pivot upwardly to its stop position and so on. As the cable is drawn in, the ramp is rolled up towards the shore. The installation of the ramp is a reverse process of unrolling the ramp into the water. With appropriate modification the ramp may be used as a roll-up dock.

10 Claims, 3 Drawing Sheets

BOAT RAMP

FIELD OF THE INVENTION

The present invention relates to a launching ramp for recreational and the like boats and also possibly for light aircraft on floats.

BACKGROUND

A launching ramp may be installed at a boat launching site to support a boat or float plane as it is launched or docked. The ramp may slope down into the water and carry a dolly that will support the boat on the ramp until the water is deep enough for the boat to float off the dolly. For docking, the boat is brought onto the doily and the boat and dolly are pulled up the ramp, for example, using a cable and winch.

Boat ramps are subject to weather damage, particularly ice damage in the winter. Consequently, the ramps must be removed each fall and reinstalled each spring before and after freeze up. This can be an arduous process, involving the carrying of a long, heavy and awkward ramp into and out of a body of water.

The present invention is concerned with a novel boat ramp that is more readily installed and removed from a body of water when desired.

SUMMARY

According to the present invention there is provided a boat launching and docking apparatus comprising an elongate ramp having an inner end and an outer end and comprising a plurality of ramp segments arranged end to end, hinge means connecting adjacent ramp segments for relative pivotal movement about transverse axes and stop means limiting the relative pivotal movement of adjacent ramp segments.

The hinged design allows the ramp segments to follow the contour of the shore or bank and allow it to be easily winched or manually pulled up and out of the water for storage.

For winching, a cable or rope may be connected to the outer end of the ramp and pulled towards the inner end, thus rolling up the segments of the ramp sequentially towards the inner end and thus drawing the ramp from the water.

BRIEF DESCRIPTION OF THE DRAWINGS

In the accompanying drawings, which illustrate an exemplary embodiment of the present invention.

DETAILED DESCRIPTION

Figure 1:
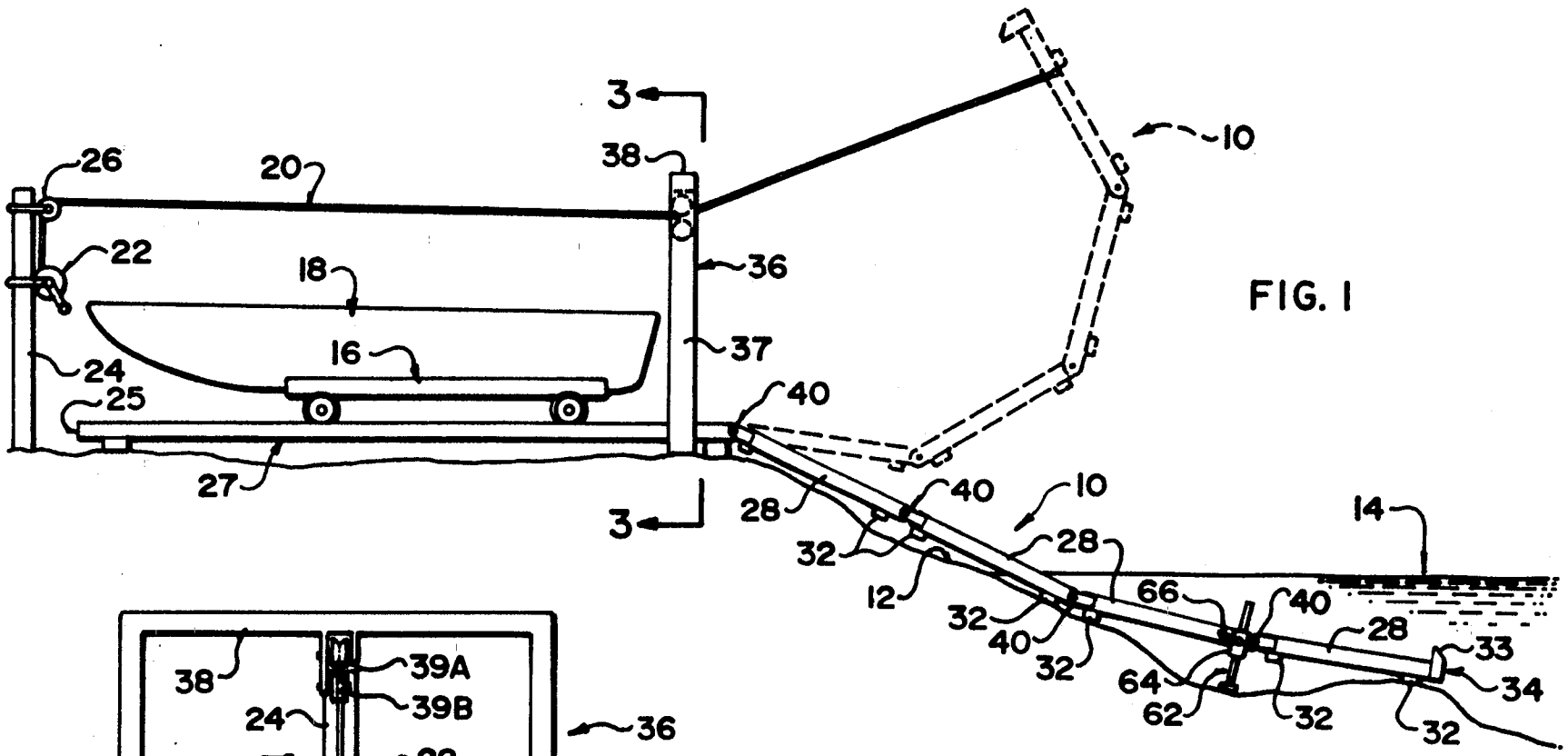
FIG. 1 is a side elevation of a ramp when in place.
Figure 3:
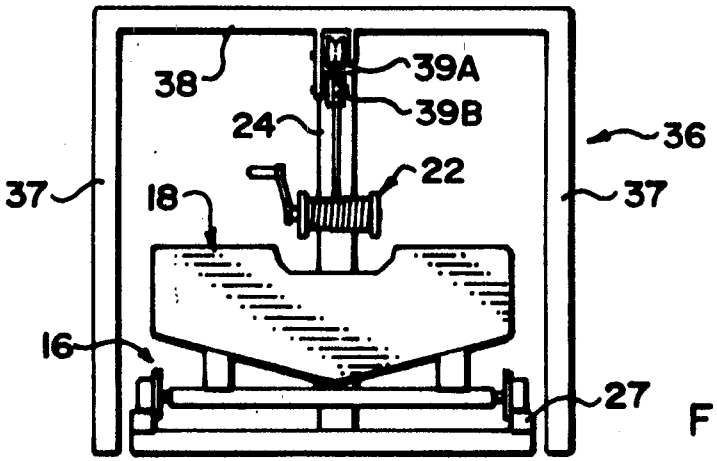
FIG. 3 is a section along line 3—3 of FIG. 1.
Figure 2:
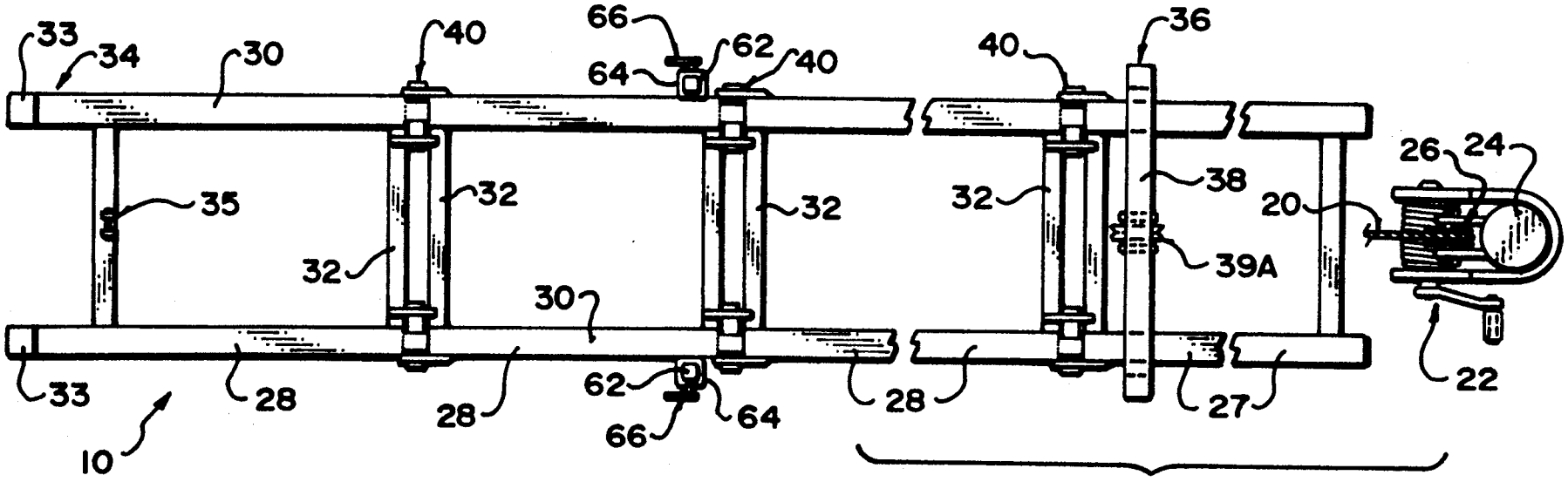
FIG. 2 is a plan view of the ramp.
Figure 4:
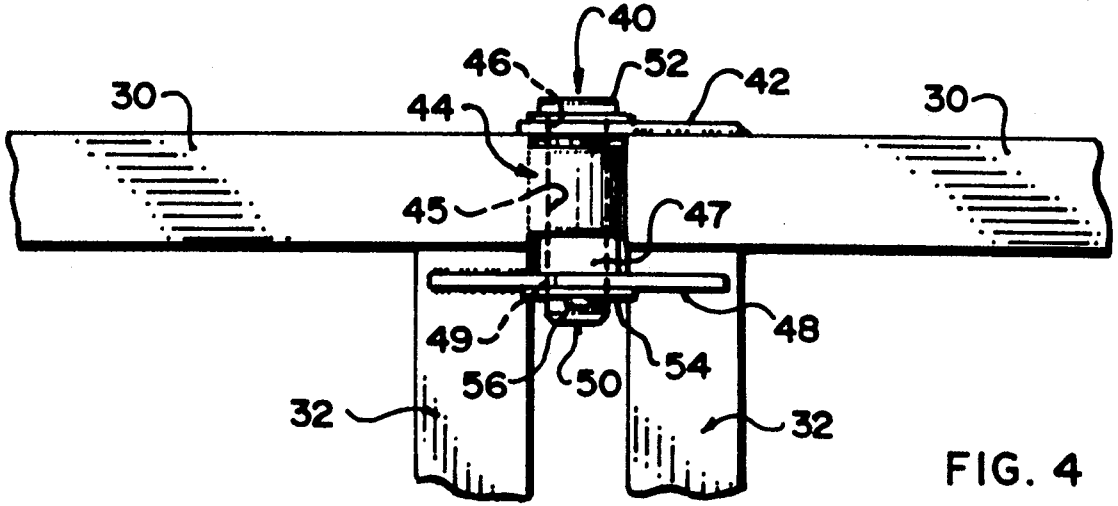
FIG. 4 is a top view of a hinge.
Figure 5:
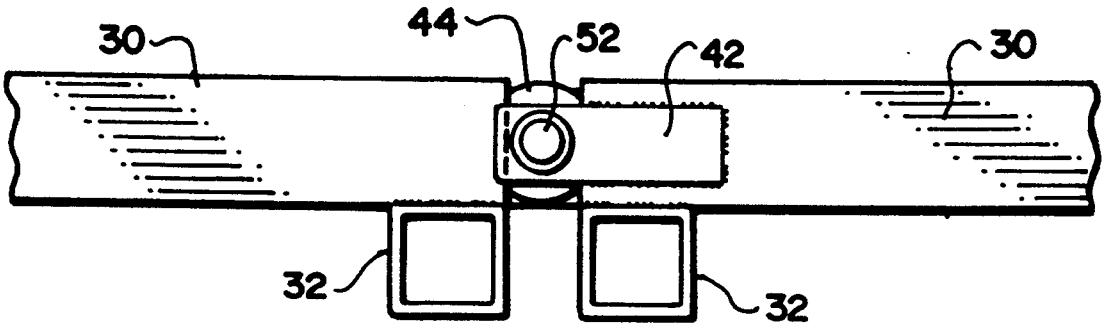
FIG. 5 is a side view of the hinge.
Figure 6:
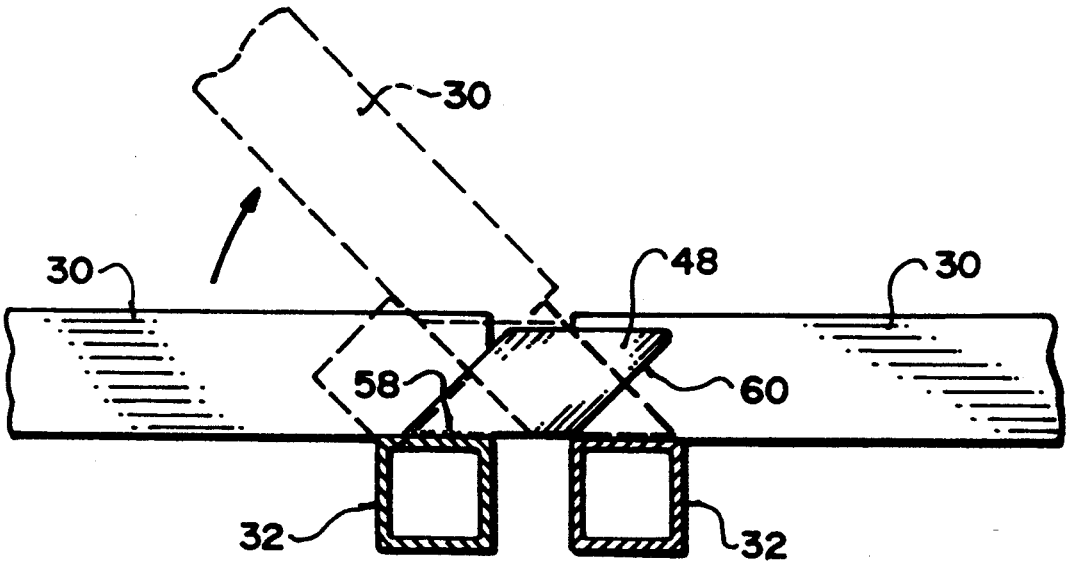
FIG. 6 is a cross section along line 6—6 of FIG. 4.

Referring to the accompanying drawings, and especially to FIGS. 1 and 2, there is illustrated a ramp 10 installed along a shore 12 in which the land surface runs down into a body of water 14. A dolly 16 is supported on the ramp for travel along the ramp while supporting a boat 18.

A cable 20 is wound on a winch 22 in turn mounted on a standard 24 at the inner end 25 of the ramp 10. The standard also carries a sheave 26 above the winch. The cable may be connected to the bow of the boat 18 and wound in on the winch to pull the boat onto the dolly and thence up the ramp 10.

The ramp is made up of an innermost ramp segment 27 and a number of ramp segments 28 that are shorter than segment 27, and all of similar construction. Each segment includes two parallel rails 30 that extend longitudinally of the ramp and two cross members 32 below the rails and joining the rails adjacent their opposite ends.

Two bumpers 33 are mounted on the rails 30 at the outer end 34 of the ramp. The cross member 32 at the outer end of the ramp also carries a cable anchor 35 so that the end of the cable 20 may be secured to the outer end of the ramp. Near the outermost end of the ramp segment 27 is an arch 36 including two standards 37 and an overhead cross member 38. The cross member carries two sheaves 39A and 39B for engaging and guiding the cable so that it will pass over the boat 18 to the sheave 26 and then down to the winch 22.

The ramp segments are connected by hinges 40. Each hinge includes a side plate 42 on the outside of one of the rails and projecting beyond its end. A bushing 44 is secured to the end of the adjacent rail on the next adjacent ramp segment with the bore 45 of the bushing in alignment with a circular aperture 46 in the plate 42. A spacer sleeve 47 is fixed to the end of the bushing, in axial alignment with the bushing and extends to a stop plate 48 fixed to the cross member 32 of the ramp segment carrying the bushing 44. The stop plate has a circular hole 49 in alignment with the bore 45 of bushing 44.

A pin 50 extends through the plate 42, the bushing 44, the spacer sleeve 46 and the stop plate 48. The pin has a head 52 at one end and is retained in place at the other end with a washer 54 and cotter pin 56.

The stop plate 48 is a vertically oriented, rhombic plate with one edge 58 secured to the top of the cross member 32 on which it is mounted. The adjacent edge, facing towards the adjacent ramp segment, is an abutment edge 60 that will engage the top face of the cross member 32 of the adjacent ramp segment when one of the segments is pivoted upwardly with respect to the other. This limits the pivoting movement to an orientation in which the two ramp segments are at an obtuse angle with respect to one another. Consequently, when the cable is connected to the outer end of the outermost ramp segment, winding in on the cable will pivot the outermost ramp segment upwardly until the stop plates 48 stop the relative pivoting movement between the end segment and the next adjacent segment. At that time, the second segment will start to pivot upwardly until it too reaches its limit point with respect to the next following segment and so on.

In this embodiment of the ramp, one of the ramp segments 28 carries two supporting legs 62. Each leg slides in a sleeve 64 mounted on a lateral extension of one of the cross members 32. The sleeves are oriented vertically and carry set screws 66 that may be set to lock the leg heights, so that the legs may support the ramp in an aligned orientation on an uneven surface. In most cases, legs are not required as the winged structure will follow the ground contour without interfering unduly with the operation of the dolly.

While one embodiment of the present invention has been described in the foregoing, it is to be understood that other embodiments are possible within the scope of the invention. For example, when the ramp is used with a boat house, the sheaves are installed on the boat house rafters. Where appropriate supporting structures, such as legs and decking are added, the ramp may be used as a dock that can be rolled up for the winter. The invention is to be considered limited solely by the scope of the appended claims.

I claim:

1. A launching and docking apparatus for boats comprising an elongate ramp having an inner end and an outer end and comprising at least three ramp segments arranged end to end, hinge means connecting adjacent ramp segments for relative pivotal movement about transverse axes, stop means limiting the relative pivotal movement of adjacent ramp segments and ramp rolling means including a winch at the inner end of the ramp and a cable having one end secured to the outer end of the ramp and an opposite end wound on the winch for winding in the cable and pivoting the ramp segments upwardly in sequence from the outer end toward the inner end.

2. Apparatus according to claim 1 wherein the ramp comprises a plurality of rails extending along the ramp and a boat supporting dolly supported on the rails to travel therealong.

3. Apparatus according to claim 2 including means connected to the one end of the cable for selectively connecting the cable to the outer end of the ramp or to a boat on the dolly.

4. Apparatus according to claim 2 including bumper means at the outer end of the ramp for preventing travel of the dolly off the outer end of the ramp.

5. Apparatus according to claim 1 wherein each ramp segment comprises two parallel rails extending longitudinally of the ramp and two transverse ramp members positioned beneath the rails adjacent the respective ends thereof.

6. A launching and docking apparatus for boats comprising an elongate ramp having an inner end and an outer end and comprising a plurality of ramp segments arranged end to end, hinge means connecting adjacent ramp segments for relative pivotal movement about transverse axes, stop means limiting the relative pivotal movement of adjacent ramp segments, each ramp segment comprising two parallel rails extending longitudinally of the ramp and two transverse ramp members positioned beneath the rails adjacen the respective ends thereof and the hinge means comprising hinge components projecting from the respective ends of each rail and pivot means pivotally coupling the hinge components of adjacent ends of adjacent ramp segments.

7. Apparatus according to claim 6 wherein the stop means comprise stop members secured to the transverse member at one end of each ramp segment for engagement with the transverse member at the adjacent end of an adjacent ramp segment.

8. Apparatus according to claim 7 including adjustable leg means mounted on the ramp for supporting the ramp above an uneven surface.

9. A launching and docking apparatus for boats comprising an elongate ramp having an inner end and an outer end and comprising a plurality of ramp segments arranged end to end, hinge means connecting adjacent ramp segments for relative pivotal movement about transverse axes, stop means limiting the relative pivotal movement of adjacent ramp segments and adjustable leg means mounted on the ramp for supporting the ramp above an uneven surface.

10. A launching and docking apparatus for boats comprising an elongate ramp having an inner end and an outer end and comprising a plurality of ramp segments arranged end to end, hinge means connecting adjacent ramp segments for relative pivotal movement about transverse axes, stop means limiting the relative pivotal movement of adjacent ramp segments and legs mounted on the ramp and decking on the ramp whereby the apparatus may be used as a dock.

* * * * *